United States Patent [19]

Toda

[11] 4,177,607

[45] Dec. 11, 1979

[54] END SURFACE MACHINING APPARATUS FOR A MATCHING WORKPIECE

[75] Inventor: Kikujiro Toda, Chita, Japan

[73] Assignee: Toyoda-Koki Kabushiki-Kaisha, Aichi, Japan

[21] Appl. No.: 874,250

[22] Filed: Feb. 1, 1978

[30] Foreign Application Priority Data

Feb. 28, 1977 [JP] Japan ..... 52/21095

[51] Int. Cl.[2] ..... B24B 49/04

[52] U.S. Cl. ..... 51/165 R; 51/5 R; 51/165.71; 51/165.91; 51/105 R

[58] Field of Search ..... 51/165.71, 165 TP, 165 R, 51/165.91, 165.83, 165.77, 105 R, 105 SP, 5 R

[56] References Cited

U.S. PATENT DOCUMENTS

| | | | |
|---|---|---|---|
| 3,077,061 | 2/1963 | St. John | 51/105 R X |
| 3,964,210 | 6/1976 | Moritomo | 51/165.71 |

*Primary Examiner*—Harold D. Whitehead

*Attorney, Agent, or Firm*—Oblon, Fisher, Spivak, McClelland & Maier

[57] ABSTRACT

An end surface machining apparatus is provided, wherein an end surface of a first workpiece is machined with a second workpiece being inserted into the first workpiece. First and second in-process gauges are engageable at their feelers with the end surface of the first workpiece and a reference end surface of the second workpiece during machining, respectively. A feed device is provided to move a work support toward the tool in the axial direction of the workpieces. A control device, controllably connected to the feed device, is responsive to output signals from both the in-process gauges, so that the end surface of the first workpiece is machined to have a predetermined size difference relative to the reference end surface of the second workpiece.

6 Claims, 4 Drawing Figures

END SURFACE MACHINING APPARATUS FOR A MATCHING WORKPIECE

BACKGROUND OF THE INVENTION

1. Field of the Invention

The present invention relates generally to machine tools and more particularly, to an apparatus for machining an end surface of one of a pair of matchable parts by reference to a reference surface of the other part in a state that the parts are mutually combined.

2. Description of the Prior Art

A machining system under a so-called matching control has heretofore been known, in which, for the purpose of enhancing fitting accuracy of a pair of parts to be mutually matched or combined, an inside diameter of one of the parts is measured by a post-process gauge while an outside diameter of the other part in process is measured by an in-process gauge, and feed movement of a machining tool is controlled to make constant the difference between the sizes measured by both the gauges. In such a known system, the surface of the one part to be machined is determined to be a fitting surface into a reference internal surface of the other part, and the fitting accuracy of the parts can be satisfied since the external surface is machined while being compared with the reference internal surface in size of diameter.

However, the known system is impossible to use in the case where one of the parts is engaged with the other part at a surface other than an external surface thereof to be machined and where the other part has a reference surface independently of an engagement surface thereof. In this case, there is conceivable the use of another machining system, wherein the other part is positioned outside the machine in a suitable manner for measurement of the reference surface by a post-process gauge, while the surface of the one part in process is measured by an in-process gauge so that feed movement of a tool is controlled to bring about coincidence between measurement signals from both the gauges. According to this system, compensation can be made for a size dispersion of engagement surfaces relative to reference surfaces of the other parts. The system, however, falls into a meaningless one because one of the parts, respectively pairing with the other of the parts, also has a disparity with the positions of engagement surfaces relative to surfaces thereof to be machined.

Another system is further conceivable which measures a size from a surface in process to an engagement surface of one of the parts as well as a size from a reference surface to a fitting surface of the other part and which controls feed movement of a machining tool to make constant the difference between both the sizes. This system is, however, impractical since it requires the use of two sizing devices for each part and, depending upon the kind of workpieces, increases the difficulty in measuring the positions of two surfaces on each part.

SUMMARY OF THE INVENTION

Accordingly, it is a primary object of the present invention to provide an end surface machining apparatus suitable for practical use in the case where one of a pair of matchable parts or workpieces is combined with the other part or workpiece at a surface other than an end surface, to be machined, thereof and where the other part has a reference surface independently of a surface thereof engaging with the one of the parts.

Another object of the present invention is to provide an end surface machining apparatus of the character set forth herein, capable of machining an end surface of one of a pair of matchable workpieces in a state that the same are mutually combined.

Another object of the present invention is to provide an end surface machining apparatus of the character set forth herein, capable of reliably holding a pair of matchable workpieces in a predetermined state of combination during machining operation.

A further object of the present invention is to provide an end surface machining apparatus, of the character set forth herein, in which one end of a first workpiece is machined to protrude therefrom by a predetermined length with one end of a second workpiece being inserted into the first workpiece.

Briefly, according to the present invention, there is provided an apparatus for machining an end surface of a first workpiece matchable to a second workpiece, which comprises a work support rotatably supporting the first and second workpieces in a state that the second workpiece is seated on a seating surface of the first workpiece; a tool support carrying a tool; a feed device for relatively feeding the work and tool supports toward and away from each other in an axial direction of the workpieces; a first in-process gauge having a feeler engageable with the end surface, to be machined, of the first workpiece on the work support; a second in-process gauge having a feeler engageable with a reference surface of the second workpiece on the work support, the reference surface being formed independently of an engagement surface where the second workpiece is seated on the seat surface of the first workpiece; and a feed control device responsive to respective measurement signals output from the first and second in-process gauges so as to control the feed device.

The feed control device calculates the size difference of the end surface, to be machined, relative to the reference surface and outputs a control signal to the feed device upon the coincidence of the size difference with a set value, whereby the end surface of the first workpiece is machined to have a predetermined dimensional relation with the reference surface of the second workpiece.

BRIEF DESCRIPTION OF THE DRAWINGS

Various other objects, features and attendant advantages of the present invention will readily be appreciated as the same becomes better understood by reference to the following detailed description of a preferred embodiment thereof when considered in connection with the accompanying drawings, wherein like reference numerals designate like or corresponding parts throughout the several views, and in which.

DETAILED DESCRIPTION OF THE PREFERRED EMBODIMENT

Figure 1:
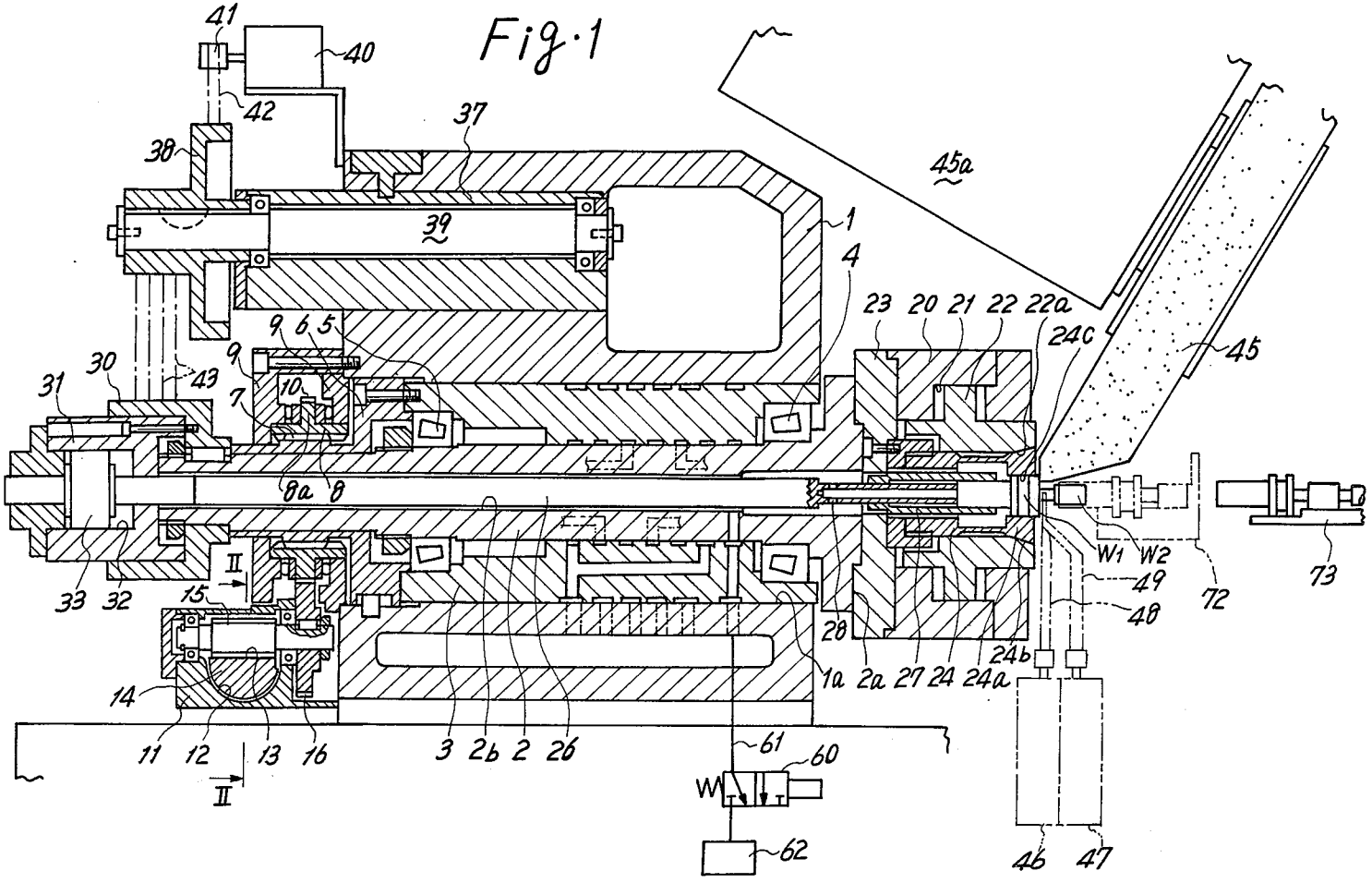
FIG. 1 is a longitudinal sectional view of an apparatus according to the present invention, particularly illustrating a workhead provided in the apparatus.
Figure 2:
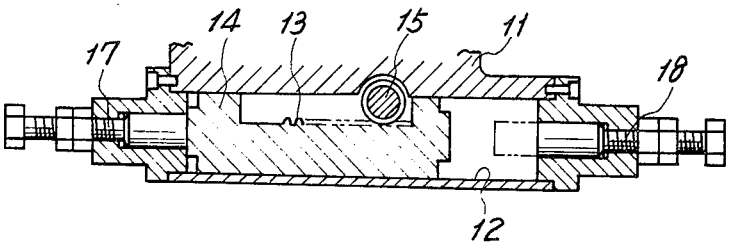
FIG. 2 is a sectional view of the apparatus, taken along the line II—II of FIG. 1.

Referring now to FIG. 1, there is shown a workhead 1, which is mounted on a table, not numbered, of a grinding machine. A slidable cylinder 3 is slidably inserted into a through bore 1*a* of the workhead 1 and rotatably supports a work spindle 2 through bearings 4 and 5. A screw sleeve 6 is secured to the rear end of the slidable cylinder 3 and is formed with a male screw 7 on the external surface of its protruded portion. A nut number 8 is threadedly engaged with the male screw 7 permitting only rotation and is supported at its flange portion 8*a* by supporting members 9 and 9 fixed on the rear end surface of the workhead 1. A gear 10 is formed on the external surface of the flange portion 8*a*. A cylinder block 11 is formed with a cylindrical bore 12, in which a rack piston 14 with a rack 13 is slidably contained. A pinion 15 gears with the rack 13 and also gears with the gear 10 on the nut member 8 through a gear 16 fixed on the same shaft. Stop screws 17 and 18 are provided, as shown in FIG. 2, for regulating stroke ends of the rack piston 14 and are adjustable with their extension amounts into the cylindrical bore 12.

A chuck housing 20 is fixed on an end surface 2*a* of the work spindle 2 through a face plate 23 and, in the inside thereof, is co-axially formed with a cylinder 21, in which a piston 22 is contained for axial sliding movement. A collet chuck 24 is secured to the face 23 at one end thereof and, at the other end thereof, is formed with a tapered surface 24*b*, whose diameter increases toward the end, and with a collet portion 24*a* having a workpiece gripping surface 24*c*. The tapered surface 24*b* is in fitting engagement with a tapered internal bore 22*a* formed on the piston 22. A push rod 26 is inserted into a through hole 2*b*, which extends on the center of the work spindle. One end of the rod 26 near the chuck 24 is inserted into a sealing sleeve 27 secured to the face plate 23 and, only at its extreme end, takes the form of a hollow pipe, defining a vacuum chamber, on which a draught hole 28 is drilled opening into the through hole 2*b*. The through hole 2*b* is in fluid communication with a vacuumizing device 62 through a magnetic change-over valve 60.

A pulley 30 and a cylinder member 31 are both fixed on the rear end of the work spindle 2. A piston 33, contained in a cylindrical bore 32 of the cylinder member 31, is connected to the push rod 26. An eccentric sleeve 37 supports a rotational shaft 39, keying thereon a pulley 38, with an eccentricity and, when adjustably rotated relative to the workhead 1, permits the adjustment of belt tension. A work drive motor 40 is mounted on the workhead 1 and provides a pulley 41 on an output shaft thereof. Belts 42 are wound round the pulleys 41 and 38, and belts 43 are wound round the pulleys 38 and 30.

Figure 3:
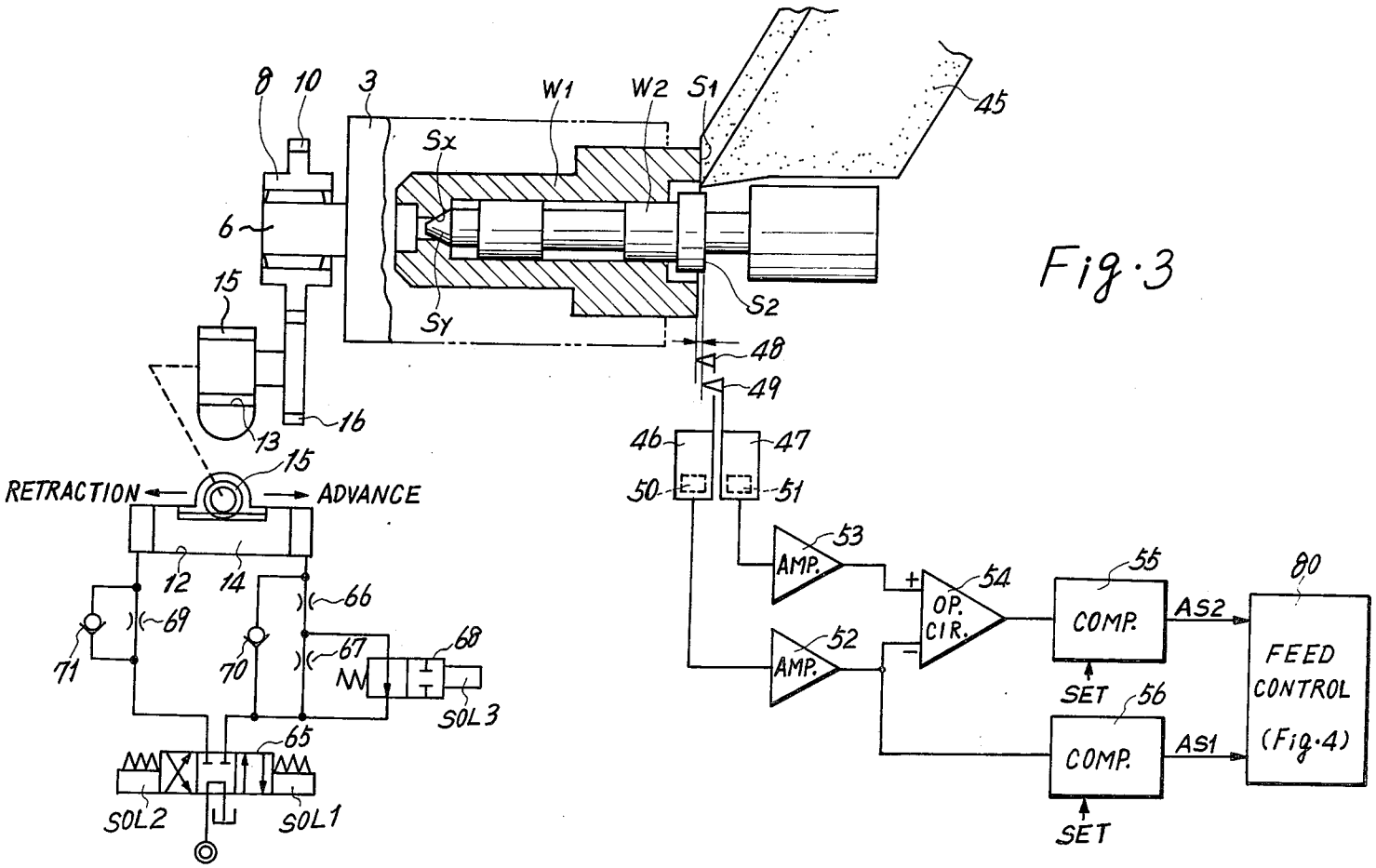
FIG. 3 is a block diagram of a control system for the apparatus.

Indicated at 45 is a grinding wheel, which is rotatably mounted on a wheel head 45*a*. The wheel head 45*a* is slidably retracted from the position as shown toward the upper-right in a slanted direction only during loading and unloading operations of workpieces. The first and second matchable workpieces are indicated, respectively, at W1 and W2 and are held by the collet chuck 24 in a combined state that, as best illustrated in FIG. 3, the second workpiece W2 is inserted into the internal hole of the first workpiece W1 to be ground and that an engagement surface Sy of the second workpiece W2 is engaged with a seat surface Sx of the first workpiece W1. In-process gauges 46 and 47 for measuring end surfaces are supported on a support member, such as the table or the like of the grinding machine, for forward and retraction movements. The gauges 46 and 47 have, pivotably supported for displacements, feelers 48 and 49, which are engageable with a ground surface S1 of the first workpiece W1 and a reference surface S2 of the second workpiece W2, respectively. The gauges 46 and 47 are further provided with displacement detectors 50 and 51, such as differential transformers, for detecting the displacements of the feelers 48 and 49, respectively. Output signals from the displacement detectors 50 and 51, after being amplified by respective amplifiers 52 and 53, are supplied to an operation circuit 54 for subtraction. The subtracted signal is supplied to a comparison circuit 55, which compares the level of the signal with that of a set value so as to output a sizing signal AS2 to a feed control circuit 80 upon the coincidence of the subtracted signal with the set value. The output signal from the amplifier 52 is also supplied to another comparison circuit 56, which compares the output signal with another set value to output another sizing signal AS1 to the feed control circuit 80.

The aforementioned first and second workpieces W1 and W2 are loaded in combined state and, with rightward movement of the piston 22, are clamped by the collet chuck 24, as shown in FIG. 1. In this state, an opposite end surface of the first workpiece W1 is in close contact with one end surface of the push rod 26. When the magnetic change-over value 60 is switched, then the conduit 61 is caused to communicate with the vacuumizing device 62, and negative pressure is applied to the opposite end surface of the first workkpiece W1 via the through hole 2*b* and the draught hole 28. The engagement surface Sy of the second workpiece W2 is thus caused to come into close contact with the seat surface Sx of the first workpiece W1, whereby a proper close contact is maintained therebetween. Thereafter, the motor 40 is driven to rotate the work spindle 2 together with the workpieces W1 and W2, and the grinding wheel 45 is advanced to such a position as illustrated.

Figure 4:
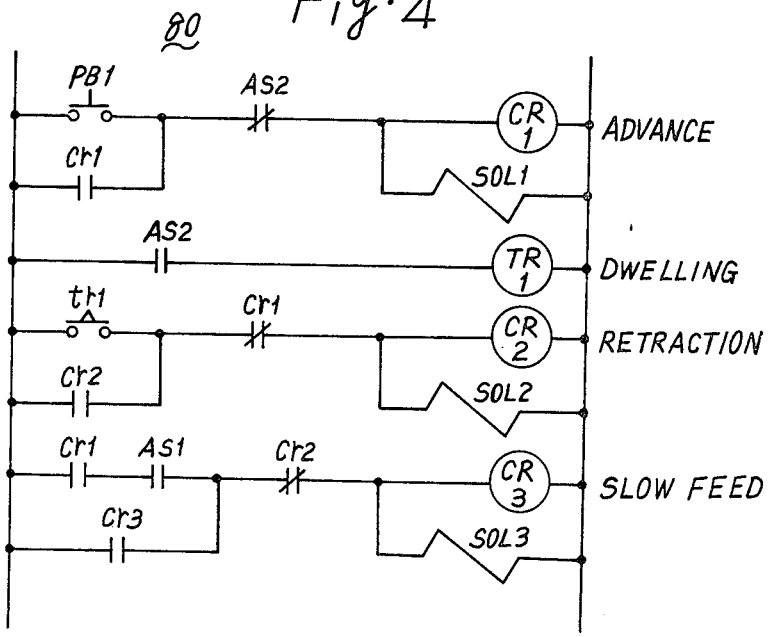
FIG. 4 is a ladder diagram of a control circuit constituting the control system.

When a grinding cycle start button PB1 shown in FIG. 4 is depressed, then a relay CR1 and a solenoid SOL1 are energized, opening a contact cr1 connected to a relay CR2 in series, which is thus deenergized together with a solenoid SOL2. A magnetic change-over valve 65 is switched to the left and supplies fluid under pressure into the left chamber of the cylinder 12 to advance the piston 14. The nut member 8 is rotated through the rack 13, the pinion 15 and the gears 16 and 10, and this effects the screw feed of the slidable cylinder 3 in its axial direction, so that the ground surface S1 of the first workpiece W1 approaches the grinding wheel 45. During this approach, a change-over valve 68 is held opening the bypass passage for a throttle 67 because of a solenoid SOL3 remaining deenergized. In this connection, the rack piston 14 is moved at a relatively fast feed rate regulated by a throttle 66, which effects quick approach of the ground surface S1 to the grinding wheel surface. When the ground surface S1 reaches a position where it is immediately before the contact with the wheel surface, the comparison circuit 56 generates the sizing signal AS1, closing a contact AS1. A relay CR3 and the solenoid SOL3 are energized through relay contacts cr1 and cr2 and the energization of the solenoid SOL3 effects the switching of the changeover valve 68 to the left to thereby close the bypass passage. The rack piston 14 is moved rightward as viewed in FIG. 3 at a slow feed rate controlled by throttles 66 and 67, whereby the workpiece W1 is axially fed in toward the grinding wheel 45 at the slow feed rate.

The ground surface S1 is ground out with the wheel 45 by the feed-in amount, while the axial position of the reference surface S2 of the second workpiece W2 is displaced by the feed-in amount relative to the ground surface S1. Accordingly, the difference between measurement signals, output from the displacement detectors 50 and 51, increases as the grinding operation progresses. Upon the coincidence of this difference with a set value, the comparison circuit 55 generates the sizing signal AS2. A contact AS2, connected to the relay CR1 in series, is thus opened to deenergize the relay CR1 and the solenoid SOL1, and simultaneously, a contact AS2, connected to a time relay TR1 in series, is closed to energize the time relay TR1. The deenergization of the solenoid SOL1 causes the switching of change-over valve 65 to its neutral position, which thus blocks the right and left chambers of the piston 14, whereby the termination of the infeed movement, accordingly dwelling is effected. When the time-up of the time relay TR1 closes its contact tr1, the solenoid SOL2 is energized, switching the change-over valve 65 to the right, and the rack piston 14 is retracted. Since the energization of the relay CR2 opens the contact cr2, which is connected to the relay CR3 in series, the same is deenergized together with the solenoid SOL3, so that this matching cycle ends with restoration to the initial state.

After the returning of the rack piston 14 to the retracted end, the changeover valve 60 is switched to apply atmospheric pressure to the opposite end surface of the first workpiece W1. The grinding wheel 45 is retracted, and the piston 22 in the chuck housing 20 is also retracted to release the collet chuck 24 from gripping operation. The piston 33, provided at the rear end portion of the work spindle 2, is then advanced to push out the first and second workpieces W1, W2 from the collet chuck 24 by the agency of the push rod 26, so that the workpieces W1 and W2 are unloaded from the machine through an unloading chute 72.

In loading new first and second matchable workpieces W1 and W2, an insertion device 73, provided in axial alignment with the axis of the work spindle 2, receives the pair of the workpieces W1 and W2 from a loading chute, not shown, and inserts the same into the collet chuck 24. The piston 22 is advanced to bring about the clamping by the collet chuck 24. With the switching of the change-over valve 60, negative pressure is applied to an opposite end surface of the first workpiece W1, whereby the engagement surface Sy is brought into close contact with the seat surface Sx. Thereafter, the machining cycle as described hereinbefore is repeated.

As mentioned previously, according to the present invention, the first and second workpieces W1, and W2 are attached to the machining apparatus in combined state, and a machining operation is carried out, with one of the workpieces whose engagement surface is in close contact with the seat surface of the other workpiece, while measuring the positions of the ground surface of the first workpiece W1 and the reference surface S2 of the second workpiece W2 by the respective in-process gauges. Accordingly, even in the case of matchable workpieces which respectively have a ground surface and a reference surface independently of engagement surfaces, the dimensional accuracy of the ground surface, formed on one of the workpieces, can be precisely regulated relative to the reference surface of the other workpiece. Further, even in the presence of a positional dispersion of the engagement surfaces, size error which results from such dispersion can be perfectly compensated therefor, and thus, highly precise machining can advantageously be achieved.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for machining an end surface of a first workpiece in a state that a second workpiece is inserted into said first workpiece and is axially positioned relative thereto with an engagement surface thereof being seated on a seat surface of said first workpiece, comprising:

a support member;

a work spindle rotatably carried on said support member for supporting said first and second workpieces;

a tool support for carrying a tool;

feed means for relatively moving said support member and said tool support toward and away from each other in an axial direction of said work spindle;

a first in-process gauge having a feeler engageable with said end surface to be machined of said first workpiece on said work spindle;

a second in-process gauge having a feeler engageable with a reference surface of said second workpiece on said work spindle, said reference surface being spaced from said engagement surface in said axial direction of said work spindle;

feed control means responsive to respective measurement output signals from said first and second in-process gauges for calculating the size difference of said end surface in process relative to said reference surface and for controlling said feed means upon the coincidence of said size difference with a set value being present therein;

a chuck provided on one end of said work spindle for clamping only said first workpiece on said work spindle;

contact establishing means for establishing a close contact of said engagement surface of said second workpiece with said seat surface of said first workpiece during measurement by said first and second in-process gauges, said chuck being operable independently of said contact establishing means for ensuring reliable clamping of said first workpiece.

2. An apparatus as set forth in claim 1, wherein said feed control means comprises:

operation circuit means receiving said respective measurement signals for calculating said size difference of said end surface in process relative to said reference surface;

comparison circuit means for comparing said size difference with said set value so as to output a coincidence signal upon the coincidence of said size difference with said set value; and feed control circuit means circuit means responsive to said coincidence signal for stopping the operation of said feed means.

3. An apparatus as set forth in claim 2, wherein said support member is slidable in said axial direction of said work spindle and wherein said feed means comprises:

an actuator; and a screw and nut mechanism connected between said support member and said actuator and operated by said actuator for moving said support member in said axial direction of said work spindle under the cooperative actions of said screw and a nut threadedly engaged therewith.

4. An apparatus as set forth in claim 3, wherein contact establishing means comprises:

means provided in said work spindle for defining a vacuum chamber in contact with the other end surface of said first workpiece being gripped by said chuck;

vacuumizing means fluidly communicated with said vacuum chamber for producing negative pressure within said vacuum chamber to apply negative pressure to said seat surface of said first workpiece and said engagement surface of said second workpiece; and a change-over valve interposed between said vacuum chamber and said vacuumizing means.

5. An apparatus as set forth in claim 4, wherein said means for defining said vacuum chamber includes a tubular portion and comprising:

a push rod axially slidably received in said work spindle and formed with said tubular portion at its one end; and an actuator provided on said work spindle for axially moving said push rod so as to thereby push out said first and second workpieces from said chuck after the machining of said end surface.

6. An apparatus as set forth in claim 5, wherein said tool support comprises a wheel carrier for rotatably carrying a grinding wheel as said tool.

* * * * *